US008822866B2

(12) United States Patent
Fasano

(10) Patent No.: US 8,822,866 B2
(45) Date of Patent: Sep. 2, 2014

(54) CIRCUIT INTERRUPTER WITH ENHANCED ARC QUENCHING CAPABILITIES

(75) Inventor: Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 299 days.

(21) Appl. No.: 13/089,925

(22) Filed: Apr. 19, 2011

(65) Prior Publication Data

US 2012/0037598 A1 Feb. 16, 2012

Related U.S. Application Data

(60) Provisional application No. 61/325,649, filed on Apr. 19, 2010.

(51) Int. Cl.
*H01H 9/44* (2006.01)
*H01H 75/02* (2006.01)

(52) U.S. Cl.
USPC ..... 218/22; 218/154; 335/16

(58) Field of Classification Search
CPC ..... H01H 9/30; H01H 9/48; H01H 9/44; H01H 9/46
USPC ..... 218/34–39, 148, 149, 156, 157, 15, 22; 335/201, 202, 16, 147, 195
See application file for complete search history.

(56) References Cited

U.S. PATENT DOCUMENTS 4,491,705 A 1/1985 Hayashi et al.
4,612,426 A * 9/1986 Maier et al. ..... 218/151
4,644,307 A 2/1987 Tanimoto
4,656,446 A * 4/1987 Chien et al. ..... 335/201
5,196,815 A * 3/1993 Chien et al. ..... 335/16

(Continued)

FOREIGN PATENT DOCUMENTS

CN 1080780 A 1/1994
CN 1298548 A 6/2001

(Continued)

OTHER PUBLICATIONS

International Search Report and Written Opinion of the International Searching Authority; Application No. PCT/US2011/033025; Issued: Jul. 11, 2011; Mailing Date: Jul. 25, 2011; 12 pages.

(Continued)

*Primary Examiner* — Amy Cohen Johnson
*Assistant Examiner* — Marina Fishman
(74) *Attorney, Agent, or Firm* — St. Onge Steward Johnston & Reens LLC

(57) ABSTRACT

A circuit interrupter has a first contact, a second contact movable with respect to the first contact, an arcing chamber, and an arc splitter. The arc splitter is located on a first side of the first contact, as is an arc runner. An electrical conductor is connected to the arc runner having a first portion running from the first side of the first contact towards a second side of the first contact, the second side being opposite the first side with respect to the first contact. A second portion is connected to the first portion and the second contact; the second portion is located on the second side of the first contact. A current running through the arc runner and the electrical conductor generates a magnetic force on the arc moving the arc toward the arc splitter.

18 Claims, 4 Drawing Sheets

(56) References Cited

U.S. PATENT DOCUMENTS

| | | | |
|---|---|---|---|
| 5,579,198 | A | 11/1996 | Wieloch et al. |
| 5,583,328 | A | 12/1996 | Mitsuhashi et al. |
| 5,731,561 | A | 3/1998 | Manthe et al. |
| 6,373,014 | B1 | 4/2002 | Mitsuhashi et al. |
| 6,480,080 | B1 | 11/2002 | Asada et al. |
| 6,717,090 | B2 | 4/2004 | Kling et al. |
| 7,081,596 | B2 | 7/2006 | Schneider et al. |
| 7,220,933 | B2 | 5/2007 | Baiatu |

FOREIGN PATENT DOCUMENTS

| | | | |
|---|---|---|---|
| CN | 101556871 | A | 10/2009 |
| JP | S51667 | A | 1/1976 |
| JP | S5866228 | A | 4/1983 |
| JP | S61285627 | A | 12/1986 |
| JP | H06139907 | A | 5/1994 |
| JP | H08264098 | A | 10/1996 |
| JP | H09293421 | A | 11/1997 |
| JP | 2004273235 | A | 9/2004 |

OTHER PUBLICATIONS

Search Report Application No. 201180004671.X, Mar. 27, 2014, 2 pages.

* cited by examiner

CIRCUIT INTERRUPTER WITH ENHANCED ARC QUENCHING CAPABILITIES

CROSS-REFERENCE TO RELATED APPLICATIONS

The present application claims the benefit under 35 U.S.C. §119(e) of U.S. Provisional Patent Application Ser. No. 61/325,649 filed on Apr. 19, 2010, the content of which is incorporated herein by reference.

FIELD OF THE INVENTION

The present invention relates generally to the protection of electrical devices, and more specifically, relates to a circuit interrupter with an arc runner that creates a magnetic field to aid in rapidly extinguishing an electrical arc. The conductor path is positioned so as to greatly increase the magnetic field generated by the flow of the current through the internal conductors. This intensified magnetic field aids in pushing the arc more quickly and efficiently toward an arc splitter to achieve enhanced interruption under fault conditions.

BACKGROUND OF THE INVENTION

A circuit interrupter is an electrical component that can break an electrical circuit, interrupting the current. A basic example of a circuit interrupter is a switch, which generally consists of two electrical contacts in one of two states; either closed, meaning the contacts are touching and electricity can flow between them, or open, meaning the contacts are separated. A switch may be directly manipulated by a human as a control signal to a system, such as a computer keyboard button, or to control power flow in a circuit, such as a light switch.

A second example of a circuit interrupter is a circuit breaker. A circuit breaker is used in an electrical panel that monitors and controls the amount of amperes (amps) being sent through the electrical wiring. A circuit breaker is designed to protect an electrical circuit from damage caused by an overload or a short circuit. If a power surge occurs in the electrical wiring, the breaker will trip. This will cause a breaker that was in the "on" position to flip to the "off" position and shut down the electrical power leading from that breaker. When a circuit breaker is tripped, it may prevent a fire from starting on an overloaded circuit; it can also prevent the destruction of the device that is drawing the electricity.

A standard circuit breaker has a line and a load. Generally, the line is the incoming electricity, most often from a power company. This can sometimes be referred to as the input into the circuit breaker. The load, sometimes referred to as the output, feeds out of the circuit breaker and connects to the electrical components being fed from the circuit breaker. There may be an individual component connected directly to a circuit breaker, for example only an air conditioner, or a circuit breaker may be connected to multiple components through a power wire which terminates at electrical outlets.

A circuit breaker can be used as a replacement for a fuse. Unlike a fuse, which operates once and then has to be replaced, a circuit breaker can be reset (either manually or automatically) to resume normal operation. Fuses perform much the same duty as circuit breakers, however, circuit breakers are safer to use than fuses and easier to fix. If a fuse blows, oftentimes a person will not know which fuse controls which specific power areas. The person will have to examine the fuses to determine which fuse appears to be burned or spent. The fuse will then have to be removed from the fuse box and a new fuse will have to be installed.

Circuit breakers are much easier to fix than fuses. When the power to an area shuts down, the person can look in the electrical panel and see which breaker has tripped to the "off" position. The breaker can then be flipped to the "on" position and power will resume again. In general, a circuit breaker has two contacts located inside of a housing. The first contact is stationary, and may be connected to either the line or the load. The second contact is movable with respect to the first contact, such that when the circuit breaker is in the "off", or tripped position, a gap exists between the first and second contact.

The problem, with circuit interrupters, is that even though it may be in the open position, i.e. a switch is open or a circuit breaker has tripped, interrupting the connection, the open area between the first and second contact allows an electrical arc to form between the two contacts. The electrical arc is the residual electricity and may have a high voltage and amperage. Arcs can be dangerous as they can cause damage to the circuit interrupter, specifically damaging the electrical contacts. Any damage to the electrical contacts shortens the lifespan of the circuit interrupter, and affects its performance. It is therefore very important to cool and quench the arc quickly to prevent damage to the circuit interrupter.

There have been many proposed devices to quickly quench an arc. For example, U.S. Pat. No. 5,731,561 to Manthe et al. discloses a device with a sealed arc chamber. Inside of the sealed arc chamber is a gas designed to quench the arc that is formed when the circuit breaker trips. A disadvantage of this device is that is expensive to produce. The circuit breaker requires a sealed chamber, which is expensive to manufacture and test, and also requires a specific, arc quenching, gas. The combination of the sealed chamber and the gas make this device very expensive. Additionally, any leaks in the chamber will cause a leak in the gas, preventing any quenching from taking place.

U.S. Pat. No. 6,717,090 to Kling et al. discloses a device with an arc splitter stack into which the arc passes via guide rails. A disadvantage of the device proposed in Kling is that is does not rapidly quench the arc. While providing some quenching using the arc splitter, the arc splitter alone does not provide enough cooling to quickly quench the arc.

What is desired therefore is a circuit interrupter that can quickly cool and quench an arc, that is inexpensive to produce, and provides rapid cooling to protect the electrical contacts in the circuit interrupter.

SUMMARY OF THE INVENTION

The invention is directed to a circuit breaker for rapidly cooling and quenching an arc. The circuit breaker directs the flow of the arc through a specially designed arc runner that uses the magnetic force of the flow of electricity to quickly force the arc from the second electrical contact to the arc splitter.

These and other objects of the present invention are achieved by provision of a circuit interrupter having a first contact, a second contact movable with respect to the first contact, an arcing chamber, and an arc splitter. The arc splitter, which has a plurality of spaced apart plates each with a v-shaped cut out, is located on a first side of the first contact. An arc runner is on the first side of the first contact. An electrical conductor is connected to the arc runner having a first portion running from the first side of the first contact towards a second side of the first contact, the second side being opposite the first side with respect to the first contact. A second portion is connected to the first portion and the second contact; the second portion is located on the second side of the first contact. A current running through the arc runner and the electrical conductor generates a magnetic force on the arc moving the arc toward the arc splitter.

In some of these embodiments, a first electrical terminal is electrically connected to the first contact and a second electrical terminal is electrically connected to the second contact. In some of these embodiments, the first electrical terminal and the second electrical terminal are located on the second side of the first contact. In some of these embodiments, a third portion is electrically connected to the second portion located on a third side of the first contact terminating at the second electrical terminal, the third side being adjacent to the first side with respect to the first contact, and the first portion, the second portion, and the third portion defines substantially a c-shape. In some of these embodiments, the first electrical terminal and the second electrical terminal are located on the third side of the first contact. In some of these embodiments, the plates are substantially rectangular. In some of these embodiments, the circuit interrupter is a circuit breaker.

In another embodiment of the present invention a circuit interrupter has a first contact, a second contact movable with respect to the first contact, and an arcing chamber. An arc splitter is located on a first side of the first contact in the arcing chamber. An arc runner is located on the first side of the first contact. A first electrical terminal and a second electrical terminal are located on a second side of the first contact, the second side being opposite to the first side with respect to the first contact. An electrical conductor is connected to the arc runner, and has a first portion and a second portion. The first portion runs from the first side of the first contact toward the second side of the first contact. The second portion is electrically connected to the first portion, the second contact, and the second electrical terminal, and is located on the second side of the first contact. A current runs through the arc runner and the electrical conductor and generates a magnetic force on the arc causing the arc to move toward the arc splitter.

In some of these embodiments, the arc splitter is a plurality of spaced apart plates. In some of these embodiments, each of the plates have a substantially v-shaped cut out on one side. In some of these embodiments, the plates are substantially rectangular. In some of these embodiments, the circuit interrupter is a circuit breaker.

In another embodiment of the present invention a circuit breaker has a first contact, a second contact movable with respect to the first contact, and an arcing chamber. An arc splitter is located on a first side of the first contact in the arcing chamber. An arc runner is located on the first side of the first contact. A first electrical terminal and a second electrical terminal are located on a third side of the first contact, the third side being adjacent to the first side with respect to the first contact. An electrical conductor connected to the arc runner has a first portion, a second portion, and a third portion. The first portion runs from the first side of the first contact towards the second side of the first contact, the second side being opposite the first side with respect to the first contact. The second portion is electrically connected to the first portion and the second contact, and is located on the second side of the first contact. The third portion is electrically connected to the second portion and the second terminal, and is located on the third side of the first contact. A current running through the arc runner and the electrical conductor generates a magnetic force on the arc causing the arc to move toward the arc splitter.

In some of these embodiments, the arc splitter is a plurality of spaced apart plates. In some of these embodiments, the plates each have a substantially v-shaped cut out. In some of these embodiments, the plates are substantially rectangular. In some of these embodiments, the circuit interrupter is a circuit breaker. In some of these embodiments, the electrical conductor defines substantially a c-shape around the first and second contacts.

In another embodiment of the present invention a circuit interrupter has an arc splitter and an arc runner. The arc runner has an electrical conductor running substantially parallel to an arc and disposed on a side of the arc opposite the arc splitter. The electrical conductor boosts the arc toward the arc splitter when a current is passed through the electrical conductor.

In some of these embodiments, a second electrical conductor is electrically connected to the electrical conductor running substantially perpendicular to the arc. In some of these embodiments, a third electrical conductor is electrically connected to the electrical conductor running substantially perpendicular to the arc.

DETAILED DESCRIPTION OF THE INVENTION

Figure 1:
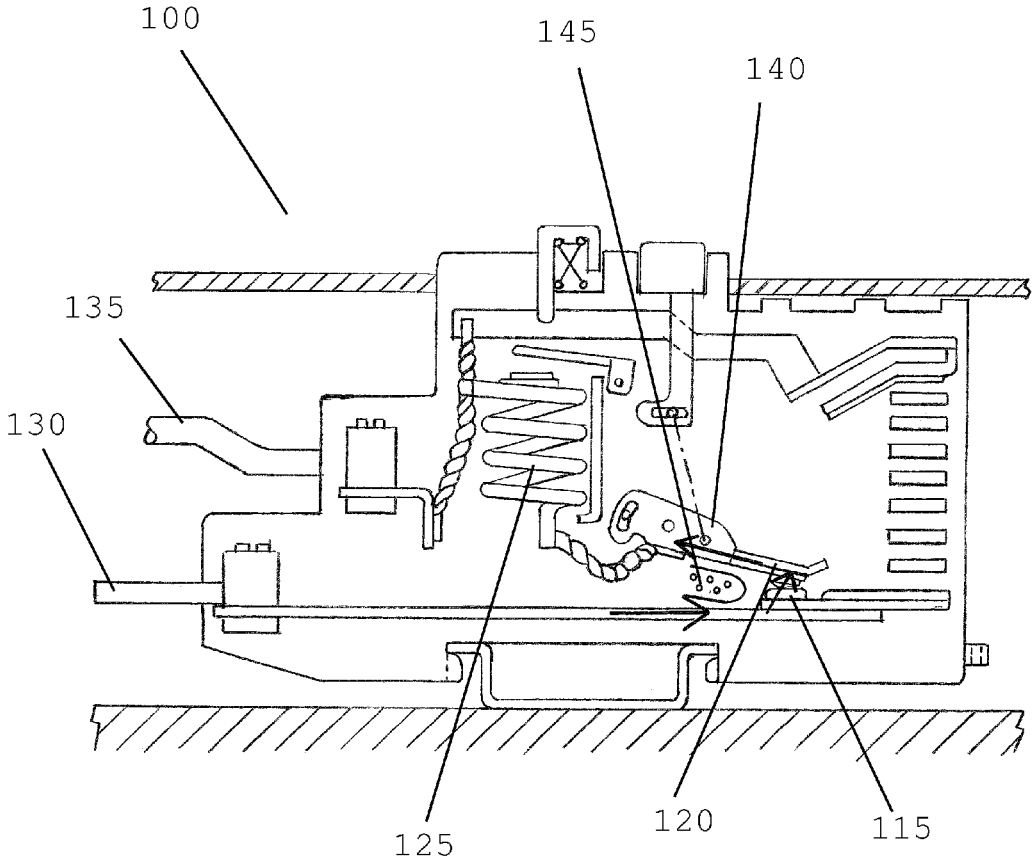
FIG. 1 is a side view of a circuit interrupter, in a closed position, according to the present invention.

The exemplary embodiments of the present invention may be further understood with reference to the following description and the related appended drawings, wherein like elements are provided with the same reference numerals. The exemplary embodiments of the present invention are related to a device for quenching an electrical arc. Specifically, the device uses magnetic fields to quickly boost arc movement toward an arc splitter, thereby causing the arc to be quickly cooled and quenched. The exemplary embodiments are described with reference to a circuit breaker, but those skilled in the art will understand that the present invention may be implemented on any electrical device that has electrical contacts that can be opened and closed, As best seen in FIG. 1, a circuit breaker 100 according to one embodiment of the present invention is shown in the closed position. Circuit breaker 100 can be used in any commercial or non-commercial application, and may be designed to replace current circuit breakers without the need to modify existing equipment. Circuit breaker 100 is designed to quickly cool and quench an arc; this allows circuit breaker 100 to be used with equipment that requires a high voltage. For example, the circuit breaker may have dimensions as small as 2.625 inches high, 3.7 inches long, and 0.5 inches thick. A typical circuit breaker of this size is rated for a voltage of approximately 160 V; however, a circuit breaker according to the present invention can be rated at 250 volts or higher. It should be noted that the dimensions above are purely exemplary, and the current design can be used in any size circuit breaker, larger or smaller than detailed above, and can be rated for a voltage higher or lower than 250 volts.

Electricity, generally from a power company, flows into circuit breaker 100 through terminal 130. Terminal 130, which can be referred to as the line, is connected to a first contact 115. First contact 115 remains stationary, attached to the housing of circuit breaker 100. A second contact 120 is movable with respect to first contact 115. Generally electrical contact 120 is connected to the load, or the equipment drawing power, however, electrical contact 120 may be connected to the line or the load. Electrical contact 120 is movable with respect to electrical contact 115. During normal operation, circuit breaker 100 is in a closed position whereby electrical contact 120 touches electrical contact 115. This allows electricity to flow from the line to the load. If there is an overload or a short in the circuit, circuit breaker 100 automatically trips, causing electrical contact 120 to separate from electrical contact 115. Electrical contact 120 may be electrically connected to a trip mechanism 125, including a solenoid and overcurrent sensor, which is electrically connected to terminal 135. Terminal 135 is generally connected to the components being powered.

Figure 2:
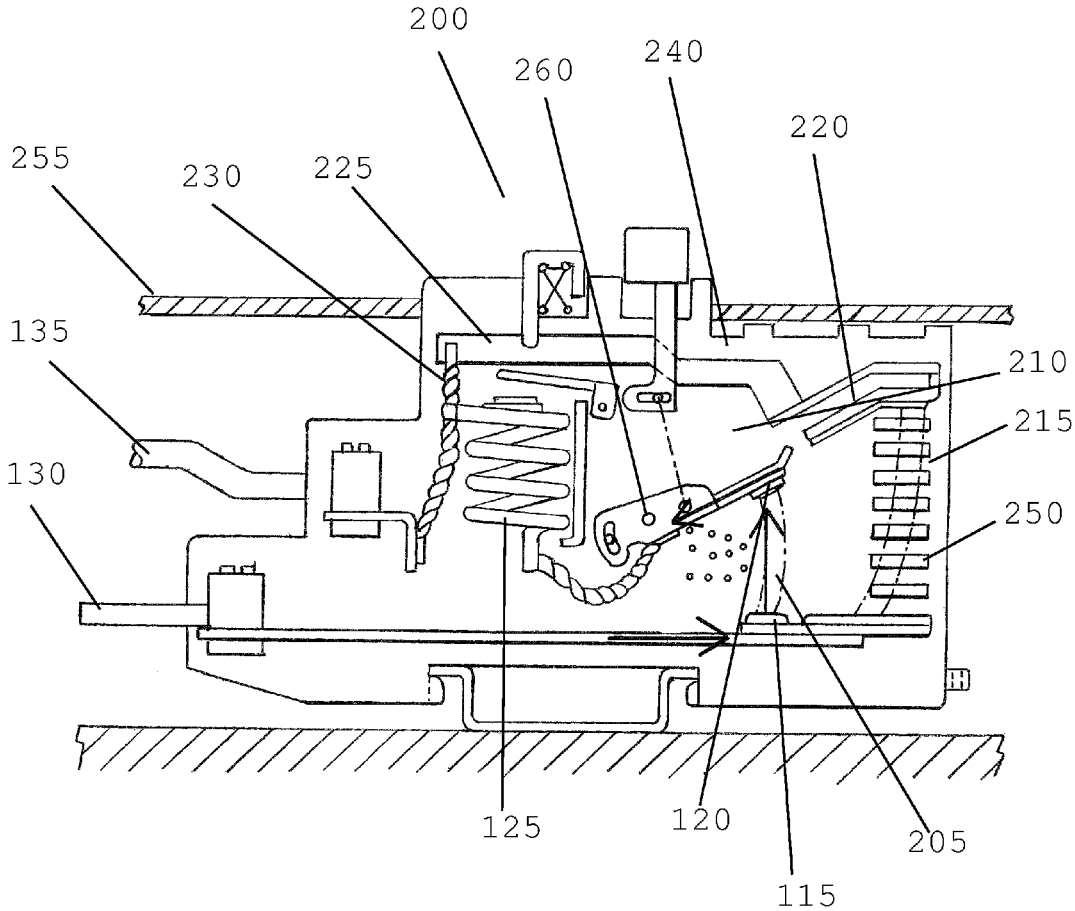
FIG. 2 is a side view of the circuit interrupter from FIG. 1 in an open position.

As best seen in FIG. 2, circuit breaker 100 in the open position is shown. Circuit breaker 100 has either been manually opened, to shut off electricity to a particular area, or circuit breaker 100 may have automatically tripped from an overloaded circuit. Although electrical contact 120 has separated from electrical contact 115, electricity, in the form of an arc 205 may still flow from electrical contact 115 to electrical contact 120 in arc chamber 210. Arc 205 is capable of jumping between electrical contacts, through air, and can cause severe damage to both contacts. In a worst case scenario a single arc 205 can damage the contacts so severely as to render them inoperable during normal operation. To protect electrical contacts 115 and 120, and circuit breaker 100, arc 205 must be extinguished as quickly as possible. This is done by pushing arc 205 into an arc splitter 215.

Arc splitter 215 may be a plurality of spaced apart, generally metallic, plates 250 which draws arc 205 in, and cools and quenches the arc. Each plate 250 may be spaced apart at the same distance, or the distance between each plate 250 may change depending on the application of circuit breaker. For example, each plate 250 may be spaced apart approximately 2 millimeters from the next plate, or the distance between each plate 250 may be varied, for example the plates toward the top of the housing may be closer together than the plates towards the bottom of the housing, or vice versa. The position of arc chamber 210 allows for more plates to be used in arc splitter 215, which provides for a quicker cooling and quenching of arc 205.

Each plate 250 has an opening to allow arc 205 to flow through. Arc 205 generates a perpendicular magnetic field (explained in more detail below) circumferentially around arc 205. As arc 205 flows through the openings in plates 250, the magnetic field generated by arc 205 boosts arc 205 further into the opening until it comes into contact with the metallic portion of plate 250. The structure of plate 250 will be explained in more detail below. Arc splitter 215 can then quickly cool and quench arc 205. To provide a quicker cooling and quenching of arc 205, it is beneficial to provide additional magnetic forces pushing or pulling arc 205 into arc splitter 215.

Terminal 130 is located on a side opposite to that of arc splitter 215. Electricity flows in a first direction through terminal 130 and into first contact 115, which is in electrical contact with second contact 120. Electricity flows into second electrical contact 120, and substantially reverses direction into arm conductor 260 to a direction almost opposite to that of the electricity that flows in through terminal 130 (FIG. 1). The reversal of the direction of the flow of electricity creates a c-shaped electrical flow (generally indicated by element 140 in FIG. 1) between terminal 130, first contact 115, and second contact 120. The c-shaped electrical flow creates an intense magnetic field (generally indicated by dots 145 in FIG. 1) in the area between the electrical flow. When circuit breaker 100 trips, causing second contact 120 to separate from first contact 115, the intense magnetic field causes an initial magnetic boost, which aids in boosting arc 205 from second contact 120 into arc runner 240, specifically into arc strap 220. Additionally, immediately after circuit breaker 100 trips, arc 205 is generated between first contact 115 and second contact 120, maintaining the c-shaped magnetic field even after circuit breaker 100 has tripped, aiding in quickly boosting arc 205 from second contact 120 to arc strap 220. The intense magnetic field ceases once arc 205 is boosted away from second contact 120, though a less intensive magnetic field is still present from the current flow through conductors 225 and 230. Arc strap 220 may face electrical contact 115 to provide a large surface area for arc 205 to come into contact with. However, arc strap 220 can face any direction, or be of any or size, such that arc 205 can contact arc strap 220. Arc strap 220 is electrically connected to electrical conductor 225, which is also electrically connected to electrical conductor 230, so a magnetic field is continuously generated from electrical conductor 230 even though the more substantial initial magnetic field from the c-shape is no longer generated.

Electrical conductor 230 terminates at terminal 135, which is located on a side opposite to arc splitter 215. As the terminals are located on a side opposite to arc splitter 215, electrical conductor 230 is able to be placed behind electrical contacts 115 and 120, to produce additional magnetic forces boosting arc 205 into arc splitter 215. This allows for a quicker cooling and quenching of arc 205 as it is boosted quickly into arc splitter 215, which can quickly cool and quench arc 205. Additionally, the size of housing 255 of circuit breaker 100 can be significantly decreased, allowing for a smaller footprint with a higher rated voltage.

Figure 3:
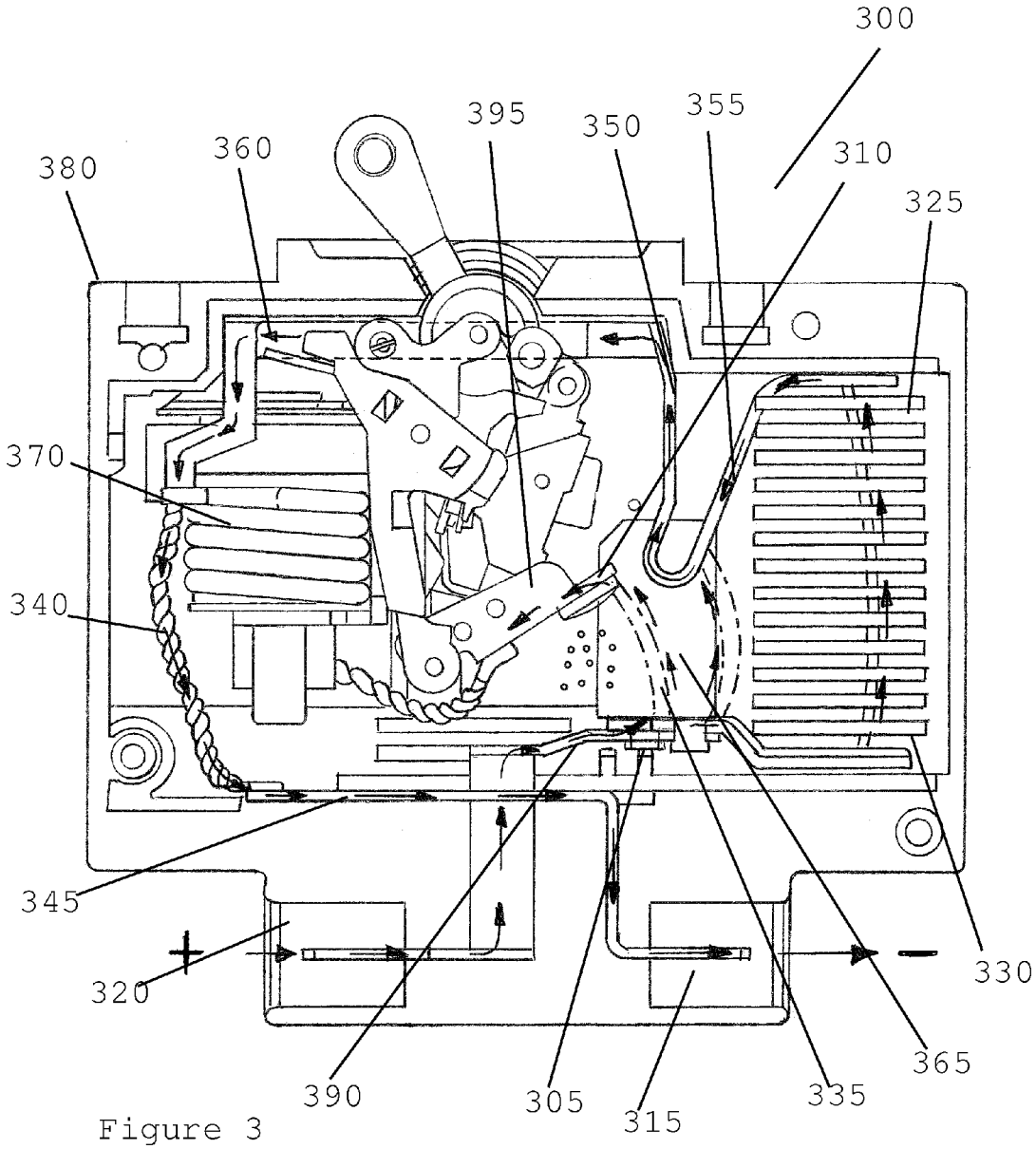
FIG. 3 is a side view of a second circuit interrupter, in an open position, according to another embodiment of the present invention.

As best seen in FIG. 3, a circuit breaker 300 in the open position according to another embodiment of the present invention is shown. Circuit breaker 300 has either been manually opened, to shut off electricity to a particular area, or circuit breaker 300 may have automatically tripped from an overloaded circuit. Although electrical contact 310 has separated from electrical contact 305, electricity, in the form of an arc 335 may still flow from electrical contact 305 to electrical contact 310 in arc chamber 365. Arc 335 is capable of jumping between electrical contacts, through air, and can cause severe damage to both contacts. To protect electrical contacts 305 and 310, and circuit breaker 300, arc 335 must be extinguished as quickly as possible. This is done by pushing arc 335 into an arc splitter 325.

Arc splitter 325 may be a plurality of spaced apart, generally metallic, plates 330 which draws arc 335 in, and cools and quenches the arc. Each plate 330 has an opening to allow arc 335 to flow through. The position of arc chamber 365 allows for more plates to be used in arc splitter 325, which provides for a quicker cooling and quenching of arc 335.

Arc 335 generates a perpendicular magnetic field (explained in more detail below) circumferentially around arc 335. As arc 335 flows through the openings in plates 330, the magnetic field generated by arc 335 boosts arc 335 further into the opening until it comes into contact with the metallic portion of plate 330. Arc splitter 325 can then quickly cool and quench arc 335. To provide a quicker cooling and quenching of arc 335, it is beneficial to provide additional magnetic forces pushing or pulling arc 335 into arc splitter 325.

Terminal 320 is located on a side adjacent to that of arc splitter 325. Electricity enters through terminal 320 in a first direction. In the figure, it is shown that electricity flows into terminal 320 from a location opposite to that of arc splitter 325, however, electricity may flow in through terminal 320 from a location adjacent to that of arc splitter 325. Once the electrical flow enters in through terminal 320, the electricity flows through conductor 390 into first electrical contact 305, which is in electrical contact with second electrical contact 310. Electricity flows into second electrical contact 310, and substantially reverses direction through arm conductor 395 to a direction almost opposite to that of the electricity that flows through electrical conductor 390. The reversal of the direction of the flow of electricity creates a c-shaped electrical flow between electrical conductor 390, first contact 305, second contact 310, and arm conductor 395. The c-shaped electrical flow creates an intense magnetic field in the area between the electrical flow.

When circuit breaker 300 trips, causing second contact 310 to separate from first contact 310, the intense magnetic field causes an initial magnetic boost, aiding in boosting arc 335 from second contact 320 into arc runner 350, specifically into arc strap 355. Additionally, immediately after circuit breaker 300 trips, arc 335 is generated between first contact 305 and second contact 310, maintaining the c-shaped magnetic field even after circuit breaker 300 has tripped, aiding in quickly boosting arc 335 from second contact 310 to arc strap 335. The magnetic field ceases once arc 335 is boosted away from second contact 310.

Arc strap 355 may face electrical contact 305 to provide a large surface area for arc 335 to come into contact with. However, arc strap 355 can face any direction, or be of any or size, such that arc 335 can contact arc strap 355. Arc strap 355 is electrically connected to electrical conductor 360, which is also electrically connected to electrical conductor 340, so a magnetic field is continuously generated from electrical conductor 340 even though arc 335 does not flow through electrical contact 310.

Electrical conductor 340 is connected to electrical conductor 345 which runs perpendicularly to arc 335, and parallel to the direction of the flow of electricity through electrical conductor 390. The combination of the magnetic fields create by the parallel flow of electricity from conductor 390 and conductor 345, in the vicinity of the c-shaped electrical flow, generates an even more intense, and continuous, magnetic field which boosts arc 335 into arc splitter 325, which quickly cools and quenches arc 335. Electrical conductor 345 terminates at terminal 315, which is located at the bottom of housing 380. The location of the terminals allows circuit breaker 300 to have a small footprint, while maintaining a high voltage rating because of the quick cooling and quenching of the electrical arc. Circuit breaker 300 can therefore be used in components requiring a higher voltage than a standard circuit breaker, while only requiring a small area to be inserted into.

Figure 4:
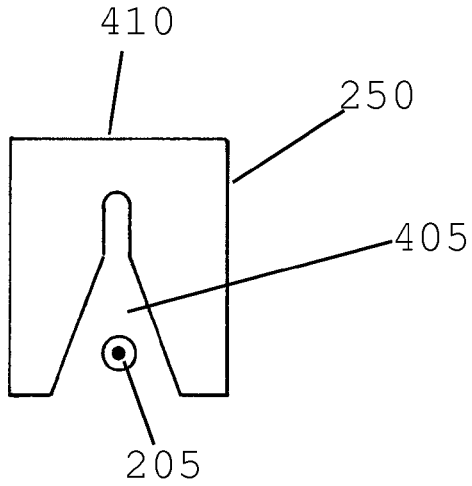
FIG. 4 is a top down view of a plate from an arc splitter from FIG. 2 and FIG. 3.

As best seen in FIG. 4, a plate from an arc splitter is shown. Plate 250 may be similar to plate 250 from FIG. 2 or plate 330 from FIG. 3. A plurality of plates 250 may be used in a single arc splitter, and its shape and composition quickly cools and quenches an electrical arc 205. In a preferred embodiment, plate 250 is shaped as a rectangle. However, plate 250 can be shaped as a circle, an oval, or any other geometric shape that allows for a cut-out in the middle. Plate 250 is preferably made from a metallic material capable of reacting to a magnetic field, this allows arc 205 to be quickly boosted into plate 250.

Plate 250 has an opening 405. In a preferred embodiment the opening is shaped as a triangle, with a circular portion 410 at the base of the triangle. However, opening 405 can be of any shape and size, and need not have a circular portion 410. Additionally, circular portion 410 can be shaped as a square, a rectangle, or any other geometric shape. When arc 205 enters opening 405, the magnetic field created by arc 205 interacts with the metallic portion of plate 250. The magnetic field is created perpendicularly to the direction of arc 205, and runs circumferentially around arc 205. As the magnetic field successively rotates around arc 205, the magnetic field is drawn to the metallic portion of plate 250, which draws in arc 205. Eventually, arc 205 comes into direct contact with the metallic portion of plate 250, and jumps, through the air, between each successive plate. As the arc contacts plate 250, jumps through the air, and contacts another plate, the arc is cooled and quenched. Each progressive arc through the plurality of plates 250, in the arc splitter, cools and quenches the arc until the arc ceases.

Figure 5:
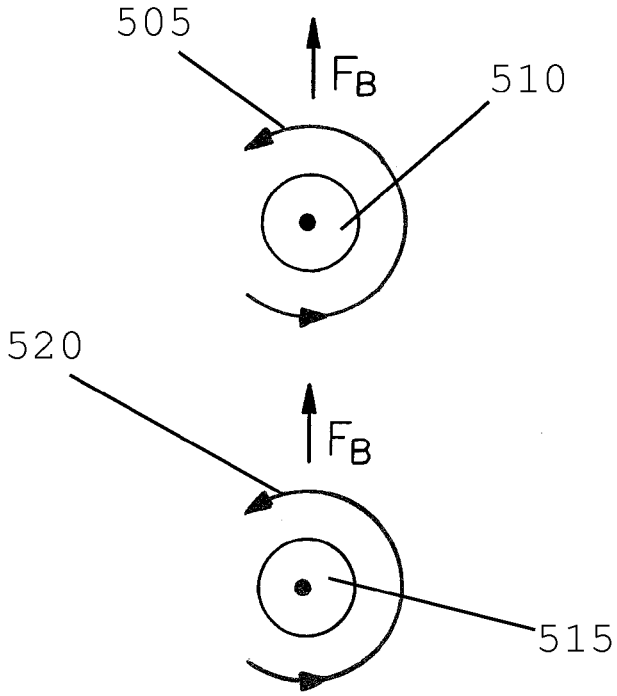
FIG. 5 is a schematic representation of two electrical conductors with magnetic fields illustrating operation of the circuit interrupter of FIG. 3.

As best seen in FIG. 5, a schematic representation of two electrical conductors illustrates operation of the present invention. Electrical conductors 510 and 515 are electrical conductors as seen from the top. The electrical current running through the electrical conductors 510 and 515 is running in upward direction. As is known the in the art, when a current is flowing through an electrical conductor 510, a magnetic force 505 is generated around the conductor 510. The magnetic force 505 runs perpendicular to the direction of the current, running circumferentially around the conductor 510. The direction of the magnetic force 505 depends on the direction of the electrical current, and is governed by the right hand rule which states that if a person places their hand in a fist with their thumb up, the magnetic field 505 runs in a counterclockwise direction around their thumb. Conversely, if a person points their thumb down, magnetic field 505 would run in a clockwise direction.

Electrical conductors 510 and 515 both run in an upward direction, both electrical conductors generating their own perpendicular magnetic field. The combination of the two magnetic fields creates an intense magnetic field greater than each individual magnetic field. This intense magnetic field is how the electrical arc, described above with reference to FIG. 3, is boosted quickly into the arc splitter to be cooled and quenched.

This device has the advantage in that it can be rated for use with a much higher voltage than a standard circuit breaker while still retaining a small size. It can quickly cool and quench an arc by using magnetic fields to boost the electrical arc towards the arc splitter, and can protect the electrical contacts, and the circuit breaker, from damage, extending the lifespan of the circuit breaker. This provides for a large cost savings as it saves money in the cost of a replacement of a circuit breaker, and the cost of labor in replacing the circuit breaker.

It would be appreciated by those skilled in the art that various changes and modification can be made to the illustrated embodiment without departing from the spirit of the invention. All such modification and changes are intended to be covered hereby.

What is claimed is:

1. A circuit interrupter comprising:

a first contact;

a second contact;

an arcing chamber;

an arc splitter located in said arcing chamber;

an arc runner located in said arcing chamber;

a first electrical conductor electrically connected to said first contact;

a second electrical conductor electrically connected to said second contact, said second electrical conductor movable from a first position in which said first contact and said second contact are electrically connected to a second position in which said first contact and said second contact are not electrically connected;

wherein a current flowing through said second electrical conductor runs in a direction substantially opposite to a direction in which the current flows through said first electrical conductor;

wherein the current flowing through said first electrical conductor, said first contact, said second contact, and said second electrical conductor generates a magnetic force boosting an arc towards said arc splitter;

a third electrical conductor electrically connected to said second electrical conductor and positioned such that said second electrical conductor moves away from said first electrical conductor and said third electrical conductor when said second electrical conductor moves from said first position to said second position, wherein a current flowing through said third electrical conductor runs in a direction substantially parallel to the direction in which the current flows through said first electrical conductor; and wherein a magnetic field generated by the current flowing through said third electrical conductor combines with a magnetic field generated by the current flowing through said first electrical conductor so as to enhance the magnetic force boosting the arc towards said arc splitter.

2. The circuit interrupter of claim 1, wherein said arc splitter is a plurality of spaced apart plates.

3. The circuit interrupter of claim 2, wherein each of said plates have a substantially v-shaped cut out on one side.

4. The circuit interrupter of claim 2, wherein said plates are substantially rectangular.

5. The circuit interrupter of claim 1, wherein said circuit interrupter is a circuit breaker.

6. The circuit interrupter of claim 1, wherein said first electrical conductor, said first contact, said second contact, and said second electrical conductor substantially define a C-shape.

7. A circuit interrupter comprising:

a first contact;

a second contact;

a first electrical conductor electrically connected to said first contact;

a second electrical conductor electrically connected to said second contact, said second electrical conductor movable from a first position in which said first contact and said second contact are electrically connected to a second position in which said first contact and said second contact are not electrically connected;

wherein a current flowing through said second electrical conductor runs in a direction substantially opposite to a direction in which the current flows through said first electrical conductor;

wherein the current flowing through said first electrical conductor, said first contact, said second contact, and said second electrical conductor generates a magnetic force when the current flows through the circuit interrupter;

a third electrical conductor electrically connected to said second electrical conductor and positioned such that said second electrical conductor moves away from said first electrical conductor and said third electrical conductor when said second electrical conductor moves from said first position to said second position, wherein a current flowing through said third electrical conductor runs in a direction substantially parallel to the direction in which the current flows through said first electrical conductor; and wherein a magnetic field generated by the current flowing through said third electrical conductor combines with a magnetic field generated by the current flowing through said first electrical conductor so as to enhance the magnetic force generated by the current flowing through said first electrical conductor, said first contact, said second contact, and said second electrical conductor.

8. The circuit interrupter of claim 7 further comprising an arc strap and an arc splitter located in an arcing chamber.

9. The circuit interrupter of claim 8, wherein said arc splitter is a plurality of spaced apart plates.

10. The circuit interrupter of claim 9, wherein each of said plates have a substantially v-shaped cut out on one side.

11. The circuit interrupter of claim 9, wherein said plates are substantially rectangular.

12. The circuit interrupter of claim 7, wherein said circuit interrupter is a circuit breaker.

13. The circuit interrupter of claim 7, wherein said first electrical conductor, said first contact, said second contact, and said second electrical conductor substantially define a c-shape.

14. A circuit interrupter comprising:

a first contact;

a second contact;

an arcing chamber;

an arc splitter located in said arcing chamber;

an arc runner located in said arcing chamber;

a first electrical conductor electrically connected to said first contact;

a second electrical conductor electrically connected to said second contact, said second electrical conductor movable from a first position in which said first contact and said second contact are electrically connected to a second position in which said first contact and said second contact are not electrically connected;

wherein a current flowing through said second electrical conductor runs in a substantially opposite direction then when the current flows through said first electrical conductor; and a third electrical conductor electrically connected to said second contact and said arc runner and positioned such that said second electrical conductor moves away from said first electrical conductor and said third electrical conductor when said second electrical conductor moves from said first position to said second position, wherein the current flowing through said third electrical conductor runs in a direction substantially parallel to the direction in which the current flows through said first electrical conductor;

wherein the current flowing through said first electrical conductor, said first contact, said second contact, and said second electrical conductor defines a c-shape which generates a magnetic force when a current flows through the circuit interrupter; and wherein a magnetic field generated by the current flowing through said third electrical conductor combines with a magnetic field generated by the current flowing through said first electrical conductor so as to enhance the magnetic force generated by the current flowing through said first electrical conductor, said first contact, said second contact, and said second electrical conductor.

15. The circuit interrupter of claim 14 further comprising an arc strap and an arc splitter located in an arcing chamber.

16. The circuit interrupter of claim 15, wherein said arc splitter is a plurality of spaced apart plates.

17. The circuit interrupter of claim 16, wherein each of said plates have a substantially v-shaped cut out on one side.

18. The circuit interrupter of claim 16, wherein said plates are substantially rectangular.

* * * * *